United States Patent [19]

Herring

[11] 4,157,670

[45] Jun. 12, 1979

[54] TICKET VENDING HEAD

[75] Inventor: Lloyd D. Herring, Jenison, Mich.

[73] Assignee: Rowe International, Inc., Whippany, N.J.

[21] Appl. No.: 819,251

[22] Filed: Jul. 27, 1977

[51] Int. Cl.[2] ..... B65H 35/06

[52] U.S. Cl. ..... 83/165; 83/176; 83/209

[58] Field of Search ..... 83/380, 212, 243, 298, 83/176, 165; 312/39; 194/10, DIG. 8; 221/2, 13; 225/103, 104, 105, 32; 270/67

[56] References Cited

U.S. PATENT DOCUMENTS

| | | | |
|---|---|---|---|
| 2,973,707 | 3/1961 | Crivelli | 194/10 X |
| 3,256,760 | 6/1966 | Vaero | 83/176 |
| 3,894,669 | 7/1975 | Wescoat | 83/212 X |
| 3,978,958 | 9/1976 | Zandstra | 221/22 X |

*Primary Examiner*—Stanley H. Tollberg

*Attorney, Agent, or Firm*—Shenier & O'Connor

[57] ABSTRACT

A ticket dispensing head for delivering individual tickets from a string of tickets connected by laterally extending lines of ticket material weakness in which tickets are advanced along a generally linear path past a breaker blade toward a limit switch adjustably positioned in the path of movement of the tickets beyond the breaker blade by a distance slightly greater than the length of a ticket with actuation of the switch interrupting the ticket drive to position the line of weakness connecting the leading ticket to the next ticket just beyond the blade breaker edge to permit a folder to fold the ticket along the so positioned line over the blade breaker edge for severing of the first ticket precisely along said positioned line upon subsequent actuation of the breaker blade to move along a path generally parallel to the ticket path. The position of the switch is adjusted to accommodate tickets of different size.

19 Claims, 5 Drawing Figures

16
18
10
126
46
12
14
36
100
98
92
28
30
94
96
26
24
22
32
38
44
42
44
34
42
44
40
20

TICKET VENDING HEAD

BACKGROUND OF THE INVENTION

Various forms of apparatus are known in the prior art for advancing a string of tickets from a supply and for severing individual tickets and delivering them to a customer. Usually, such tickets are separated by a laterally extending line of weakness. One form of such apparatus incorporates a sprocket wheel having teeth adapted to engage notches or holes along the edge of the tickets. The sprocket is driven until the line of weakness connecting the leading ticket to the remaining tickets in the string is positioned in the path of movement of a cutter or breaker blade which is driven to sever the leading ticket from the remaining tickets in the string.

The ticket dispensing apparatus described above incorporates a number of disadvantages. First, the size of the tickets being dispensed cannot readily be changed unless the pitch or distance between successive feeding notches or holes for the new size ticket is an integral multiple of the original distance between feeding notches or holes. If such is not the case, then the feeding wheel must be changed. Moreover, ticket feeding apparatus of this type requires either that the string of tickets originally be formed with advancing perforations or holes or that the string be so perforated prior to use on the apparatus.

Attempts have been made in the prior art to overcome the difficulties of ticket delivery apparatus of the type described hereinabove. One attempt to overcome these difficulties is the use of friction rollers as a ticket advancing means in combination with means for sensing the leading edge of the ticket to stop the advance of the ticket with the line of weakness of material connecting the leading ticket to the remaining tickets in the string positioned in the path of a breaker blade or cutter which moves in a direction generally perpendicular to the direction of movement of the string of tickets. While such an arrangement permits of the ready adjustment of the apparatus to accommodate tickets of different sizes, which different sizes may vary only slightly from each other, it incorporates another defect. That is to say, the breaker blade must be carefully adjusted so as to strike the line of weakness or perforations. If for any reason, at the time of the separating operation, the line of weakness is not precisely positioned with reference to the edge of the breaker blade, the leading ticket will not be cut precisely along this line. Thus, on the next operation of the machine, the edge which is sensed is not truly the leading edge of the next ticket so that the error becomes cumulative.

One example of the first type of ticket delivery apparatus described hereinabove is illustrated in Verduin et al, U.S. Pat. No. 3,770,089. Riddle et al, U.S. Pat. No. 3,621,964, and Zandstra U.S. Pat. No. 3,978,958 are illustrative of the second form of ticket delivery apparatus described hereinabove.

I have invented a ticket vending head which overcomes the disadvantages of ticket dispensing apparatus of the prior art discussed hereinabove. My ticket vending head requires no change in parts to accommodate a change in ticket size. My vending head accommodates a wide range of ticket sizes with very small differences in ticket sizes. It does not require the provision of ticket advancing notches or holes in the tickets. My ticket vending head does not require critical relative positioning of parts. It will accommodate a considerable error in line of weakness to line of weakness spacing at the ends of a ticket. My ticket dispensing head avoids the accumulation of errors which may result in the use of apparatus of the prior art.

SUMMARY OF THE INVENTION

One object of my invention is to provide a ticket vending head which will readily accommodate a wide range of ticket sizes without requiring substitution of parts.

Another object of my invention is to provide a ticket vending head which will easily accommodate relatively small changes in ticket size without substitution of parts.

A further object of my invention is to provide a ticket vending head which does not require the provision of ticket advancing notches or holes in the tickets.

Still another object of my invention is to provide a vending head which does not require critical relative positioning of parts.

Yet another object of my invention is to provide a ticket vending head which will accommodate considerable error in line of weakness to line of weakness spacing along the length of a string of tickets.

A still further object of my invention is to provide a ticket vending head which will not accumulate errors in the manner of certain ticket delivery apparatus of the prior art.

Other and further objects of my invention will appear from the following description.

In general, my invention contemplates the provision of a ticket vending head in which a drive means advances a string of tickets separated by transversely extending lines of weakness along a generally linear path toward a sensing means responsive to the leading edge of the string to interrupt the drive means with the line of weakness separating the leading ticket from the next ticket in the string located slightly beyond the breaking edge of a breaker blade mounted for movement along a path generally parallel to the path of movement of the ticket path to permit a folding member to fold the leading ticket around the so positioned line of weakness over the blade breaker edge so that the positioned line of weakness is in the path of movement of the blade and the leading ticket will accurately be severed upon subsequent movement of the blade. The leading edge sensing element may be adjusted to accommodate tickets of varying sizes.

BRIEF DESCRIPTION OF THE DRAWINGS

In the accompanying drawings which form a part of the instant specification and which are to be read in conjunction therewith and in which like reference numerals are used to indicate like parts in the various views.

DESCRIPTION OF THE PREFERRED EMBODIMENT

Figure 1:
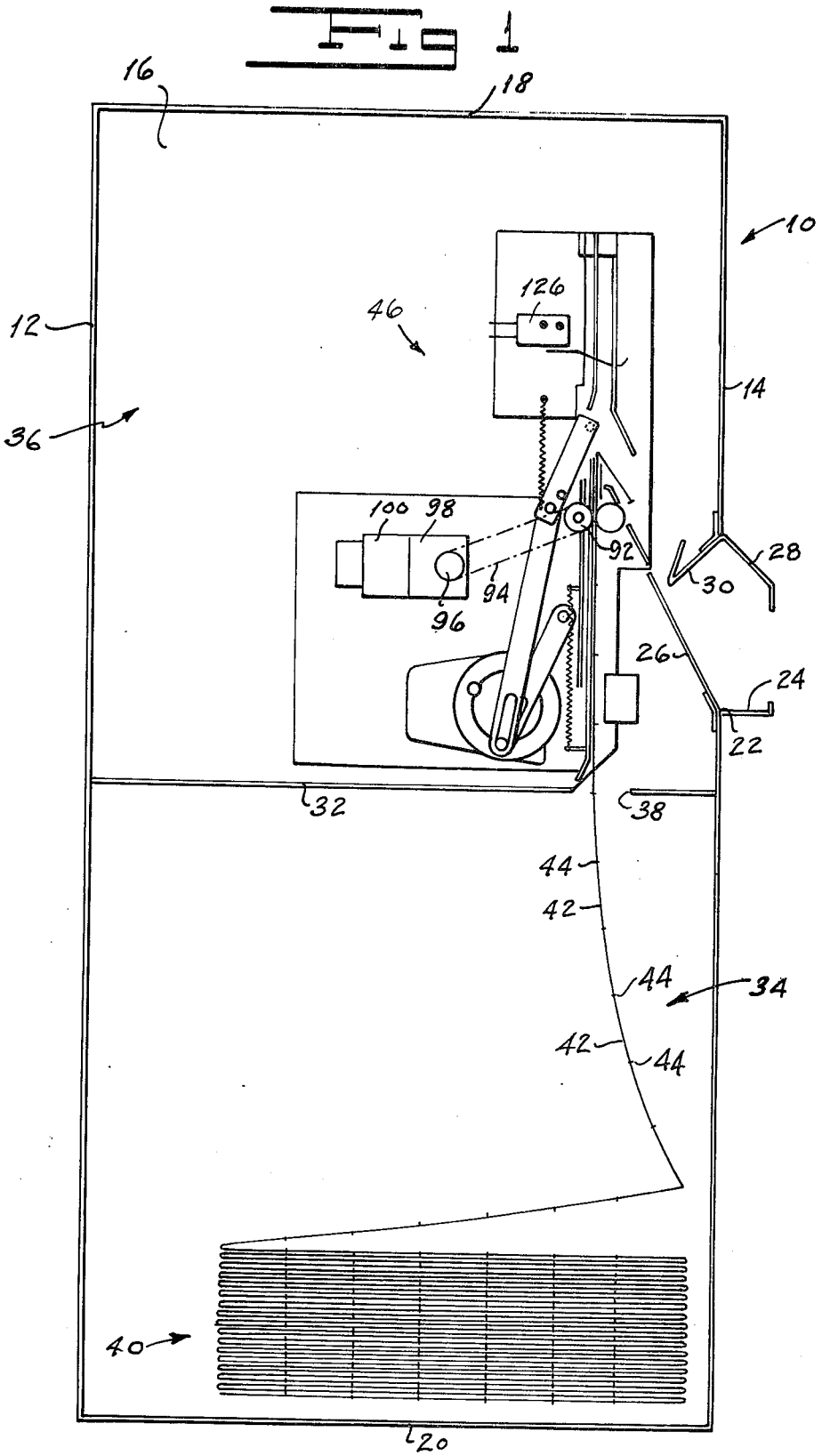
FIG. 1 is a partially schematic side elevation of a ticket merchandising machine incorporating my ticket vending head with parts removed.

Referring now to FIG. 1 of the drawings, a ticket vending machine with which my ticket vending head might be used includes a cabinet, indicated generally by the reference character 10, having a back 12, a front 14, sides 16, one of which appears in FIG. 1, a top 18 and a bottom 20. The front 14 is formed with a delivery opening 22. A first unitary member mounted along the lower edge of the opening 22 forms a delivery tray 24 and a guide 26 for directing a dispensed ticket into the tray 24. A second unitary member mounted so as to extend along the upper edge of opening 22 forms a shield 28 for the tray as well as a baffle 30 which is intended to prevent access to the interior of the cabinet 10 through the opening 22.

A horizontally extending partition 32 within the cabinet 10 divides the cabinet into a ticket supply storage area, indicated generally by the reference character 34, and a delivery head housing, indicated generally by the reference character 36. An opening 38 in the partition 32 permits a string of tickets 42 from a supply of tickets, indicated generally by the reference character 40, to move upwardly from the supply to the dispensing head, indicated generally by the reference character 46. The tickets 42 with which my head is intended to be used are connected by lines 44 of weakened material indicated schematically in FIG. 1 by dashes extending across the string of tickets. The lines 44 of weakened material are such that, in response to a force exerted against a ticket, the string will fold along a line 44. Moreover, in the usual case, tension applied to the string will cause it to part along one of the lines 44. Lines 44 may be provided by any suitable means. That is, they may be shallow cuts or lines of perforations, or the like. In the particular supply arrangement illustrated in FIG. 1, the tickets are in the form of a fan-folded supply 40. It will readily be appreciated that the tickets might as easily be arranged in a roll.

Figure 2:
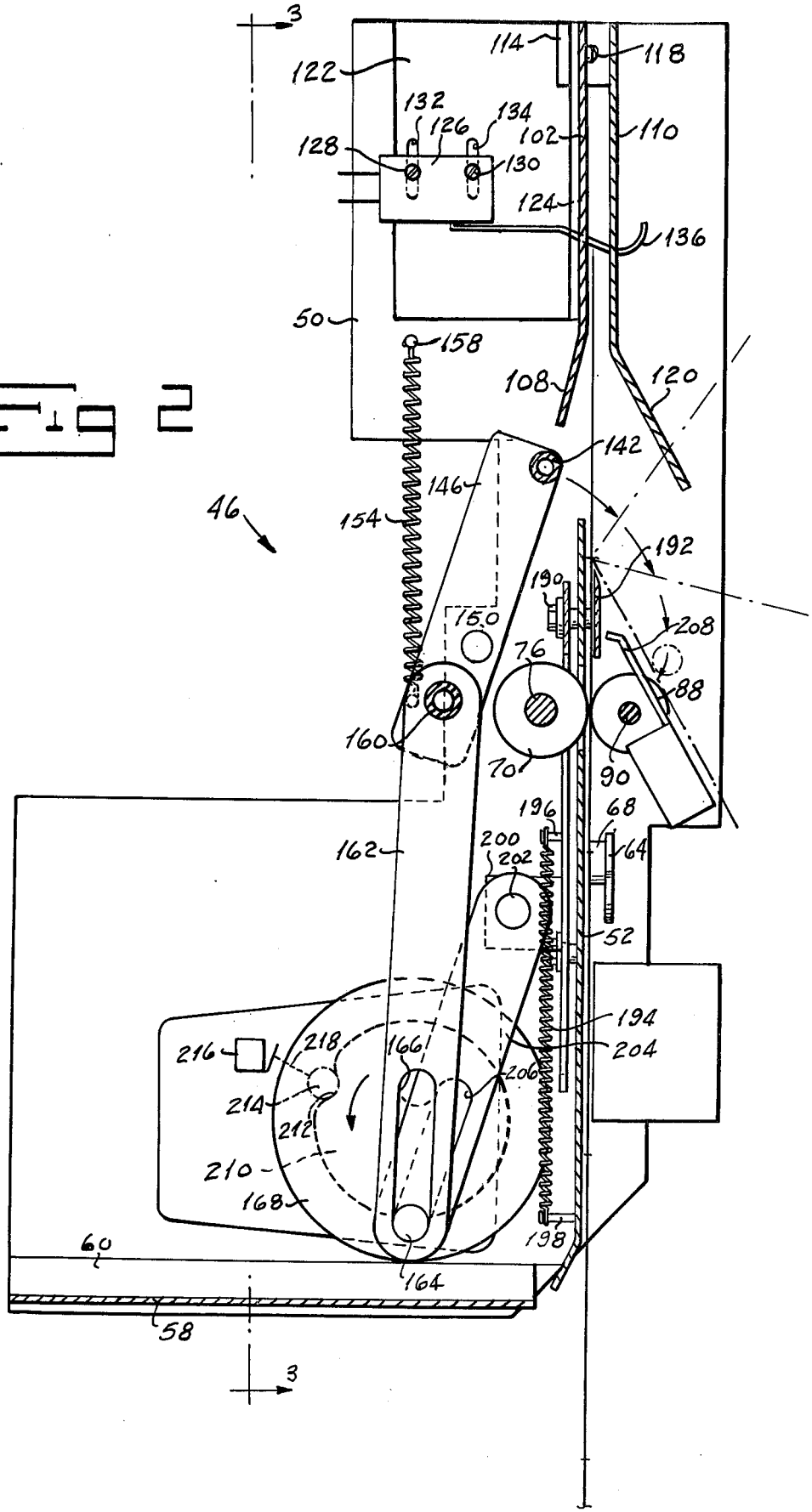
FIG. 2 is a vertical section of my ticket vending head incorporated in the machine illustrated in FIG. 1.
Figure 3:
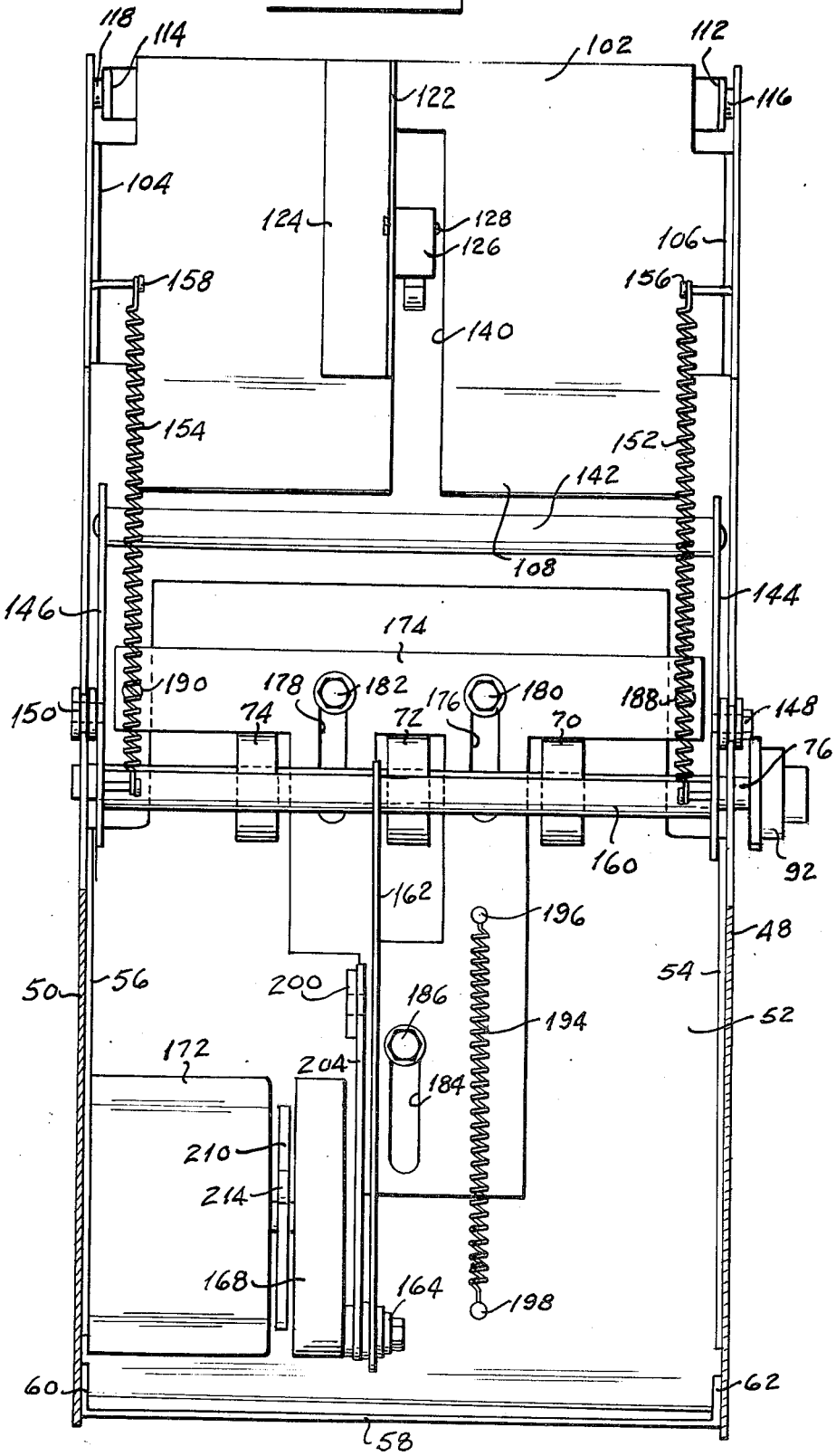
FIG. 3 is a rear elevation of my ticket vending head.
Figure 4:
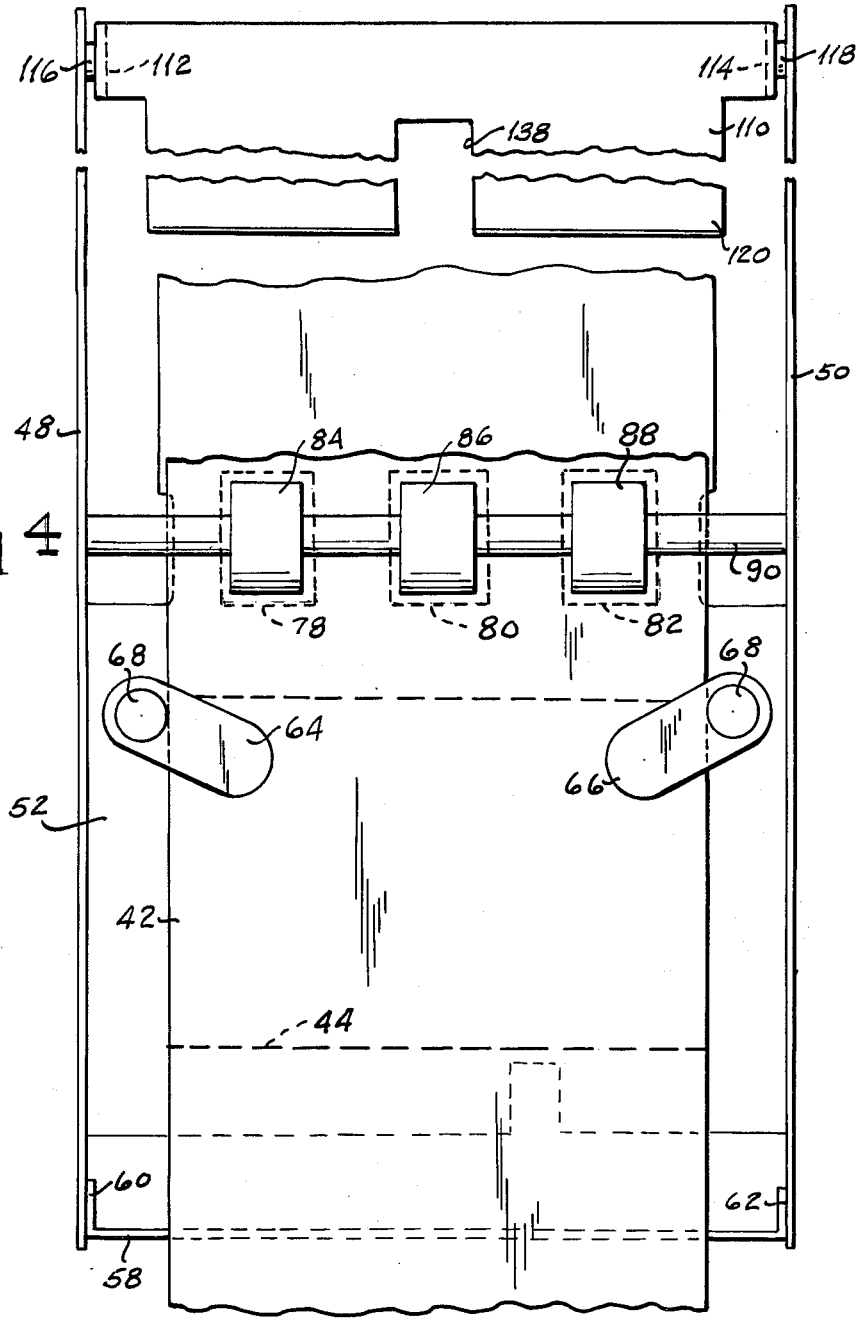
FIG. 4 is a front elevation of my ticket vending head with parts removed.

Referring now to FIGS. 2 to 4, the delivery head, indicated generally by the reference character 46, includes respective side panels 48 and 50 which are connected to a front panel 52 by means of front panel side flanges 54 and 56 which are tack-welded or otherwise secured to the side panels. A base 58 of the unit 46 is formed with edge flanges 60 and 62 which are tack-welded or otherwise secured to the side panels 48 and 50 along the lower edges thereof.

I mount respective ticket retainers 64 and 66 on the panel 52 by means of spacer posts 68 which also serve as edge guides for the strip of tickets 42.

My unit 46 includes a plurality of feed rollers 70, 72 and 74 mounted at spaced locations along a shaft 76 rotatably supported in the side panels 48 and 50. I form the front panel 52 with laterally spaced openings 78, 80 and 82 so positioned as to permit the driven feed rollers 70, 72 and 74 to cooperate with idler rollers 84, 86 and 88 mounted at spaced locations along a shaft 90 supported for rotary movement in the panels 48 and 50. Shaft 76 carries a pulley 92 for rotation therewith at one end thereof.

Referring again to FIG. 1, pulley 92 receives a belt 94 which is adapted to be driven by a pulley 96 carried by the output shaft of a speed reducer 96 driven by a motor 100.

Referring again to FIGS. 2 to 4, I tack-weld or otherwise secure side flanges 104 and 106 of a rear ticket guide 102 to the side panels 48 and 50 adjacent to the upper end of the unit. Preferably, I bend the lower edge of the guide 102 rearwardly so as to form a lip 108 which guides a ticket being fed upwardly through the head 46 along a path formed in part by the rear guide 102.

My head 46 includes a front guide 110 provided with respective ears 112 and 114 at the upper ends thereof which are received by pins 116 and 118 on panels 48 and 50 so as to mount the front guide 110 for pivotal movement around the common axis of the two pins 116 and 118. Preferably, I bend the lower edge of the guide 110 forwardly so as to form a lip 120 for catching the upper edge of a ticket moving upwardly and directing it into the space between the guides 102 and 110.

I form a bracket 122 with a flange 124 tack-welded or otherwise secured to the rear guide 102. Bracket 124 is adapted to support a switch 126 for vertically adjustable movement thereon so as to accommodate a range of sizes of tickets in a manner to be described more fully hereinbelow. Switch 126 may, for example, be mounted on the flange 124 by means of bolts 128 and 130 adjustably secured in slots 132 and 134 by means of nuts (not shown). Switch 126 includes an operating arm 136 which extends through registering openings 138 and 140 in the rear guide 102 and in the front guide 110 so as to be actuated by the leading edge of a ticket moving upwardly through the space between the two guides 102 and 110.

My unit 46 includes a folder bar 142 extending between the upper ends of a pair of levers 144 and 146. Respective pivot shafts 148 and 150 on the side panels 48 and 50 rotatably support the levers 144 and 146. A pair of springs 152, and 154, the respective lower ends of which are secured to points on the levers 144 and 146 below their respective pivots, are secured at their upper ends to pins 156 and 158 so as normally to urge the levers 144 and 146 to rotate in a clockwise direction as viewed in FIG. 2.

A bar 160 extending between the lower ends of the levers 144 and 146 receives the upper end of a link 162, the lower end of which is formed with a slot 166 for receiving a crankpin 164. Crankpin 164 is supported on a plate 168 carried by the shaft 170 of a motor 172. In the relative positions of the parts illustrated in FIG. 2, springs 152 and 154 acting on the lower ends of the levers 144 and 146 move the link 162 to a position at which the lower end of the slot 166 engages the pin 164.

My ticket dispensing unit includes a knife slide 174 provided with spaced upper slots 176 and 178 received by pins 180 and 182 carried by the panel 52. A lower slot 184 receives a third pin 186 carried by the panel 52. Screws or the like 188 and 190 disposed outboard of the lateral edges of the upper portion of the panel 52, as shown in FIG. 3, secure a knife blade 192 to the slide 174 for movement therewith along a path in front of panel 52. I secure the respective ends of a spring 194 to a pin 196 on the slide 174 and to a pin 198 on panel 52 so as normally to urge slide 174 to a position at which the upper ends of the respective slots 176, 178 and 184 rest on the pins 180, 182 and 186. A rearwardly extending ear 200 formed on the slide 174 carries a pivot pin 202 which receives the upper end of the link 204, the lower end of which is provided with a slot 206 which receives a crankpin 164. My unit includes a delivery platform 208 against which a folded but not yet cut ticket is held by the bar 142 in the rest condition of the machine in a manner to be described.

I mount a full cycle cam 210, having a recess 212 therein, on the shaft 170 for movement therewith. A follower 214, adapted to be operated by the cam 210, operates a switch 216 by means of a linkage indicated schematically at 218.

Figure 5:
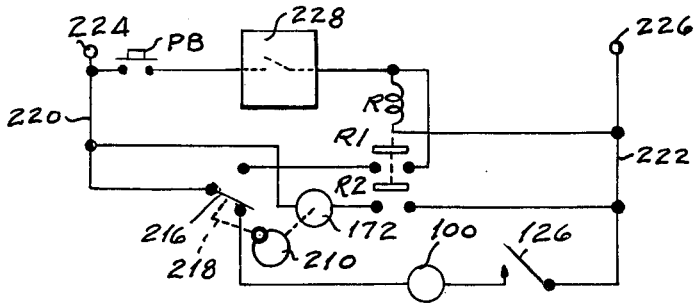
FIG. 5 is a schematic view of one form of electrical circuit which may be employed to control the operation of my ticket vending head.

Referring now to FIG. 5, one form of electrical circuit which may be used to control the operation of my ticket dispensing head includes respective conductors 220 and 222 connected to the terminals 224 and 226 of a suitable source of electrical potential. I connect a selection push-button switch PB in series with a coin-responsive mechanism 228 and a relay winding R between the conductors 220 and 222. Switch 216 is so arranged as to engage a lower contact when the follower 214 of cam 210 is in the recess 212. Moreover, when the leading edge of a ticket does not engage the switch arm 136, switch 126 is closed. I connect switch 216, its lower contact, motor 100 and switch 126 in series between the conductors 220 and 222. It will thus be appreciated that, with motor 172 deenergized and with no ticket engaging arm 136, motor 100 will be energized to drive the rollers 70, 72 and 74 until the leading edge of a ticket engages arm 136 at which time switch 126 opens to deenergize motor 100. In my system, this is the normal condition of the parts.

When a sum in money aggregating the purchase price of a ticket has been deposited in the coin mechanism 228, the selection circuit is readied. When, under this circumstance, push-button PB is operated winding R is energized to close a switch R2 to energize motor 172. As soon as the motor begins rotating, follower 214 moves arm 216 into engagement with the upper contact associated therewith. At the same time, switch R1 closes to complete a holding circuit through switch 216 to by-pass both the push-button switch PB and the coin mechanism 228. Motor 172 then continues to drive its shaft until, upon the completion of a revolution of the motor shaft, follower 214 drops back into recess 212 and switch 216 moves away from its associated upper contact to interrupt the motor holding circuit.

In the particular sequence of operations which I have selected for my ticket vending head, in the rest condition of the machine, the parts occupy the positions illustrated in the drawings. The crankpin 164 holds link 162 in the position shown against the action of springs 152 and 154. At the same time, spring 194 holds the breaker blade slide 174 in the position shown at which the upper ends of slots 176, 178 and 184 engage the pins 180, 182 and 186. Moreover, since a ticket is in engagement with the arm 136, switch 126 is open.

It will readily be appreciated that in practice cabinet 10 may house a plurality of the units 46 adapted to sell respective tickets of different kinds and at various prices and that a coin mechanism 228 common to all of the units might be provided. The unit, further, might be capable of making change. For purposes of simplicity, however, I have illustrated only one unit.

Under the initial conditions described above, assuming that a customer desiring to make a purchase has deposited in the mechanism 228 an amount of money equal to the purchase price of a ticket 42 adapted to be sold by the unit 46, he then pushes switch PB to complete the circuit of winding R to close switches R1 and R2 to energize motor 172. Shortly after its energization, motor 172 drives cam 210 to move follower 214 to engage switch 216 with the upper contact associated therewith to complete the holding circuit for the winding R. The motor 172 rotates in a counterclockwise direction, as viewed in FIG. 2. In the course of approximately the first 90° of rotation of shaft 170 and hence of crankpin 164, the springs 152 and 154 acting on the lower ends of the levers 144 and 146 swing the clamping bar 142 in a clockwise direction, as viewed in FIG. 2. In the course of this operation, the ticket which had been in engagement with the switch arm 136 moves forwardly and is folded along the line 44 of perforations, or the like, positioned just above the cutting edge of the breaker blade 192. Finally, the folder bar 142 moves the ticket into engagement with the delivery guide 208 against which the ticket is held under the action of springs 152 and 154. During this first 90° of movement of the crankpin 164, slide 174 remains in its initial position. However, by the end of the first 90° of movement of the crankpin, it has reached the upper end of the slot 206 so that for approximately the next 90° of movement of the crankpin it drives the slide 174 upwardly against the action of spring 194. As a result, blade 192 moves upwardly along a path parallel to the path of movement of the string of tickets toward the line of weakness 44 along which the leading ticket has been folded by the folder bar 142. In the course of this movement, the breaker blade 192 severs the leading ticket from the remaining tickets in the string precisely along the line 44 of perforations, or the like, between the leading ticket and the next ticket in the string. Over the next 90° of rotation of the crankpin 164 or from approximately 180° to 270°, spring 194 is permitted to retract blade 192. Over the extent of movement of the crankpin 164 from about 90° to 270°, the link 162 idles so that the leading ticket is clamped against the delivery plate 208 by the bar 142. During the final 90° of revolution of the crankpin 164, it engages the lower end of slot 166 to pull link 162 downwardly, as viewed in FIG. 2, to cause the folder bar 142 to be restored to its initial position against the action of springs 152 and 154.

Upon arrival of the crankpin 164 at its initial position, follower 214 falls into the recess 212 and switch 216 moves away from the upper contact to interrupt the holding circuit of motor 172 and into engagement with the lower contact. As the switch 216 engages its lower contact, the circuit of motor 100 will again be complete since switch 126 closed when the bar 142 moved the leading ticket away from the switch arm 136. As motor 100 drives, the string of tickets is advanced until the next ticket moves to a position at which it engages switch arm 136 to move the switch 126 to its open position. Coin mechanism 228, of course, has been reset in a manner known to the art. The unit is now ready for the next dispensing operation.

It will be seen that I have accomplished the objects of my invention. I have provided a ticket vending head which readily accommodates a wide range of ticket sizes without requiring substitution of parts. My ticket vending head easily accommodates relatively small changes in ticket size without substitution of parts. My apparatus does not require that the tickets be provided with ticket advancing notches or holes. My vending head does not require any critical relative positioning of parts. It accommodates considerable error in the line of weakness spacing along the length of a string of tickets.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for delivering tickets from a string of individual tickets separated by lines extending across said string including in combination, a blade, means mounting said blade for movement along a path between an inactive position and an active position, means for moving a string of tickets past said blade along a path generally parallel to the path of movement of said blade, means for disabling said string moving means with one of said separating lines located beyond said blade edge in the direction of movement of said string, means for folding said string along said one separating line and over said edge in the inactive position thereof, means for driving said blade from said inactive position to said active position to sever said string along said one separating line and means responsive to said blade driving means for activating said string moving means.

2. Apparatus as in claim 1 in which said folding means includes a ticket engaging member, means mounting said member for movement from a first position through a second intermediate position at which it engages a ticket located beyond said one separating line in the direction of movement of said string and to a third position at which said string is folded along said one separating line, means for biasing said member for movement from said first position to said third position, means for holding said member in said first position against the action of said biasing means and means for releasing said holding means.

3. Apparatus as in claim 2 including a delivery plate, said biasing means holding a ticket of said string against said plate in said third position.

4. Apparatus as in claim 2 in which said holding means comprises a normally deenergized motor, a crankpin adapted to be driven by said motor, and means including a link having a slot receiving said crankpin for connecting said crankpin to said motor, and in which said releasing means comprises means for energizing said motor.

5. Apparatus as in claim 4 in which said member is a bar, in which said mounting means comprises a lever, in which said biasing means comprises a spring urging said arm to rotate in a direction to move said bar from said first to said second position and in which said holding means comprises means connecting said link to said arm.

6. Apparatus as in claim 1 including means biasing said blade to said inactive position and in which said blade moving means comprises a motor, a crankpin adapted to be driven by said motor and a link having a slot receiving said crankpin and means connecting said link to said blade.

7. Apparatus as in claim 6 in which said holding means comprises a second link having a slot receiving said crankpin and means connecting said second link to said folding means.

8. Apparatus for delivering tickets from a string of individual tickets separated by lines extending across said string including in combination, means for moving a string of tickets from a supply along a predetermined path, a ticket separating blade, means mounting said blade for movement along a path generally parallel to and at one side of said ticket path from a first position along the ticket path to a second position along the ticket path, a folder bar, means mounting said folder bar for swinging across said ticket path from a rest position located along said ticket path beyond said first position and at the other side of said ticket path, means responsive to movement of said string along said path for interrupting said ticket moving means with one of said separating lines between said first and second position, means for sequentially swinging said folder bar across said ticket path to fold said string along said one separating line and for moving said blade from said first position to said second position to sever said string along said one separating line and means responsive to said last-named means for actuating said string moving means.

9. Apparatus as in claim 8 in which said string moving means comprises friction wheels and means for driving said wheels and in which interrupting means comprises a switch responsive to the leading edge of the leading ticket of said string.

10. Apparatus as in claim 8 in which said means for sequentially moving said bar and said blade comprises coin responsive means.

11. Apparatus as in claim 8 including a ticket delivery guide, said folder bar mounting means comprising a lever and means mounting said lever for pivotal movement, said means for swinging said bar comprising a spring biasing said lever to move said bar from said rest position across said path to urge a ticket against said guide, means for holding said bar against the action of said biasing means and means for disabling said holding means.

12. Apparatus as in claim 8 in which blade mounting means comprises a slide, said blade moving means comprising a spring for biasing said slide to position said blade in its first position and means for driving said blade to its second position against the action of said slide.

13. Apparatus as in claim 8 in which said sequential moving means comprises a shaft having a home position, said apparatus including means responsive to arrival of said shaft in its home position for actuating said strip moving means.

14. Apparatus as in claim 8 in which said folder bar mounting means comprises a lever and means mounting said lever for pivotal movement and in which said blade mounting means comprises a slide and in which said sequential moving means comprises a first spring biasing said lever to move said bar from said rest position across said path to fold said string, a second spring for urging said slide to a position corresponding to the first position of said blade and common means for first holding said lever against the action of said first spring and then releasing said lever to permit said first spring to act and then driving said slide against the action of said second spring.

15. Apparatus as in claim 14 in which said common means comprises a motor, a crankpin adapted to be driven by said motor, a first link having a slot for receiving said crankpin, means connecting said first link to said lever, a second link having a slot therein for receiving said crankpin and means connecting said second link to said slide.

16. Apparatus as in claim 8 including respective string retainer and edge guides for guiding said string of tickets along said path.

17. Apparatus for delivering tickets from a string of individual tickets separated by lines extending across said string including in combination, a blade having an edge, means mounting said blade for movement along a path between an inactive position and an active position, means for moving a string of tickets past said blade along a path generally parallel to the path of movement of said blade, means for disabling said string moving means with one of said separating lines located beyond said blade edge in the direction of movement of said string and in the inactive position of said blade, means adapted to be activated sequentially to swing said folder bar across said ticket path and for moving said blade from said inactive position to said active position, coin-responsive means for activating said sequentially operating means and means responsive to operation of said sequentially operating means for actuating said string advancing means.

18. Apparatus as in claim 17 in which said disabling means comprises a normally closed switch having an actuating element and means mounting said switch with the actuating element thereof in the path of the leading edge of said string.

19. Apparatus as in claim 18 in which said sequentially operating means comprises a first motor and a full revolution switch associated with said motor and in which said string moving means comprises a second motor, a source of power and means including said normally closed switch and said one revolution switch for connecting said second motor to said source.

* * * * *